United States Patent [19]

Barish

[11] 4,006,903

[45] Feb. 8, 1977

[54] ELECTRICAL TICK-TACK-TOE GAME

[76] Inventor: Benjamin J. Barish, 36 Yehuda Hanassi, Tel Aviv, Israel

[22] Filed: July 7, 1975

[21] Appl. No.: 593,730

[52] U.S. Cl. ..... 273/130 AB; 273/130 B; 273/136 A

[51] Int. Cl.[2] ..... A63F 3/00

[58] Field of Search .... 273/130 A, 130 AB, 130 B, 273/135 A, 136 A, 1 E; 35/66

[56] References Cited

UNITED STATES PATENTS

| | | | |
|---|---|---|---|
| 2,799,505 | 7/1957 | Lyons | 273/1 E |
| 2,811,359 | 10/1957 | Haufe | 273/130 AB |
| 3,563,552 | 2/1971 | Korff | 273/135 A |
| 3,894,183 | 7/1975 | Barish | 35/66 |
| 3,914,548 | 10/1975 | Barish | 35/66 |

FOREIGN PATENTS OR APPLICATIONS

| | | | |
|---|---|---|---|
| 646,542 | 8/1962 | Canada | 273/135 A |

*Primary Examiner*—Anton O. Oechsle
*Assistant Examiner*—Harry G. Strappello

[57] ABSTRACT

An electrical version of the game Tick-Tack-Toe comprises a stylus-actuated switching device including a printed circuit board carrying one group of electrically-conductive deposits, and an overlying flexible plastic sheet formed with a conductive layer facing the conductive deposits of the printed circuit board but separated therefrom by a wax coating carried either on the printed circuit board or on the flexible sheet. Both the sheet and the board are divided into a 3 × 3 matrix of 9 boxes, the electrical conductive deposits of the printed circuit board being arranged so that if an 0 mark is traced by the stylus in any box, a first electrical switch is closed by causing the wax to part and one deposit on the board to engage the conductive layer on the flexible sheet, and if an X mark is traced by the stylus in any box, a second electrical switch is closed by causing the wax to part and another deposit on the board to engage the conductive layer on the flexible sheet. The game further includes an electrical circuit effective to provide a first indicatio (e.g., the X-marker wins) when the first electrical switches of the three boxes in any horizontal row, vertical column or diagonal are all closed, and a second indication (e.g. the O-marker wins) whenever the second electrical switches of the three boxes in any horizontal row, vertical column, or diagonal are closed.

10 Claims, 2 Drawing Figures

ELECTRICAL TICK-TACK-TOE GAME

RELATED PATENT APPLICATIONS

The present invention is related to my prior U.S. Pat. application Ser. No. 490,682 filed July 22, 1974 (which is a continuation of application Ser. No. 265,985 filed June 26, 1972, now abandoned), now U.S. Pat. No. 3,894,183; and application Ser. No. 447,333 filed Mar. 1, 1974 (which is a continuation-in-part of application Ser. No. 265,985) now U.S. Pat. No. 3,914,548.

BACKGROUND OF THE INVENTION

The present invention relates to electrical games, and particularly to an electrical version of the game called Tick-Tack-Toe. The preferred embodiment of the invention disclosed uses a stylus-actuated switching device constructed according to that described in the above related patent applications.

My prior U.S. Pat. application Ser. No. 490,682 filed July 22, 1974 discloses an electrical switching device actuatable by the pressure of a stylus, which device operates in a manner somewhat resembling the mode of operation of the well known "Magic-Slate", or self-erasing slate. Briefly, the device includes a supporting member such as a printed circuit board carrying one or more electrically-conductive elements, and a flexible impression sheet carrying one or more other electrically-conductive elements placeable on top of the printed circuit board with the conductive elements of both facing each other. A coating of wax (or other equivalent material) on one or both of the above members insulates the conductive elements of both members from each other. Under the pressure of a stylus, however, the wax parts, thereby bringing a conductive element of the flexible sheet into contact with a conductive element of the printed circuit board. The wax coating, being tacky, maintains the electrical contact when the stylus is removed, but the contact is easily broken, or "erased", by merely separating the flexible impression sheet from the printed circuit board, either by manually lifting the flexible sheet, or by passing a member (e.g., a rod or roller) between the flexible sheet and the printed circuit board.

My application Ser. No. 490,682 describes a number of stylus-actuated electrical switching devices operating in accordance with the above principal, including a graphic input device or digitizer, and a stylus-actuated display system. My application Ser. No. 447333, filed Mar. 1, 1974 describes an arrangement which permits a continuous conductive pathway to be formed along the line of "write" of the stylus, one described application for such an arrangement being an instruction or assembly kit permitting various electrical circuits to be produced by merely tracing the desired conductive pathways with the stylus.

SUMMARY OF THE PRESENT INVENTION

The present invention relates to an electrical version of the game Tick-Tack-Toe, which version perferably uses a variation of the stylus-actuated electrical switching device described in the above-cited patent applications.

The game Tick-Tack-Toe is a well known game in which two players take turns marking either X's O's in an open block of nine squares, the object being to complete a straight horizontal row, vertical column, or diagonal of three of one's mark before the other player.

There are a large number of mechanical versions of this game, but I am not aware of any electrical versions.

An object of the present invention is to provide an electrical version of this game. Another object is to adapt the above described stylus-actuated switching device for providing such a game.

According to a broad aspect of the present invention, there is provided an electrical Tick-Tack-Toe game comprising an electrical switching device having a face divided into a rectangular matrix of 9 boxes arranged in three horizontal rows of three boxes in each row, and three vertical columns of three boxes in each column. The game further includes a first and a second electrical switch in each box, and electrical circuit means comprising a first electrical circuit effective to produce a first indication (e.g., the X-player wins) whenever the first electrical switches of the three boxes in any horizontal row, vertical column, or diagonal are all closed, and a second electrical circuit effective to produce a second indication (e.g., the O-player wins) whenever the second electrical switches of the three boxes in any horizontal row, vertical column, or diagonal are all closed.

In the preferred embodiment of the invention described below, the electrical switching device is the stylus-actuated switching device described in my U.S. Pat. application Ser. No. 490,682 filed July 22, 1974, and briefly described above, wherein the flexible sheet of the device is divided into the rectangular matrix of nine boxes, and the electrical conductive elements of the supporting member (e.g., printed circuit board) and of the flexible sheet are arranged so that if a first symbol is traced by the stylus in each box, the first electrical switch mentioned above is closed by causing a conductive element on the board and sheet to engage each other, and if a second symbol is traced by the stylus in each box, the second electrical switch mentioned above is closed by causing another conductive element on the board to engage that of the sheet.

According to a still further feature, the electrical circuit means further includes a third electrical circuit effective to provide a third indication whenever the first and second electrical switches are both closed in any one box, thereby indicating that the player has placed his mark in a box previously marked by the other player, and therefore loses.

Further features and advantages of the invention will be apparent from the description below.

BRIEF DESCRIPTION OF THE DRAWINGS

The invention is herein described by way of example only, with reference to the accompanying drawings, wherein.

DESCRIPTION OF THE PREFERRED EMBODIMENT

The game Tick-Tack-Toe is a well known one having many different mechanical versions. As briefly described above, the game is played by two players, each taking a turn to mark either and X or O in a rectangular matrix of nine squares or boxes, the object being for each player to complete a straight horizontal row, vertical column, or diagonal of his three marks before the other player can. The electronic version of the game illustrated in FIGS. 1 and 2 of the drawings uses the stylus-actuated switching device of my above-cited U.S. Pat. application Ser. No. 490,682, which is specifically modified to adapt it for use in this application.

Figure 1:
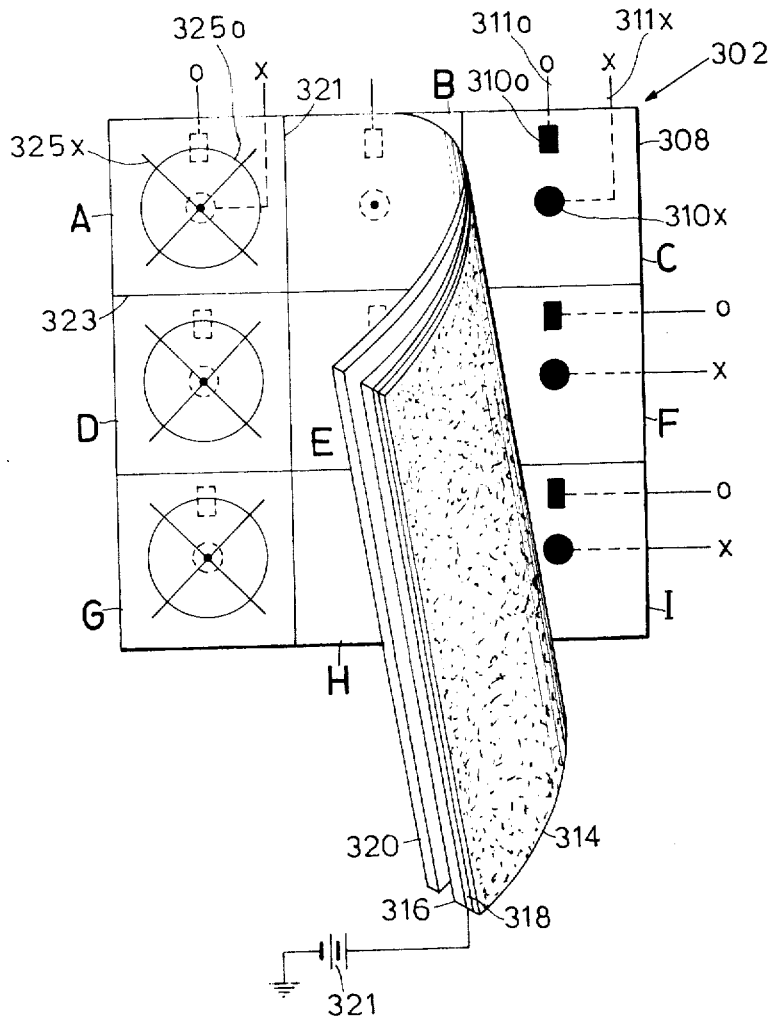
FIG. 1 illustrates a stylus-actuated switching device included in an electrical version of the Tick-Tack-Toe game constructed in accordance with the present invention.

The game illustrated in FIG. 1 is generally designated 302. It includes a supporting member 308 in the form of a printed circuit board divided into a rectangular matrix of nine boxes A–I arranged in three horizontal rows of three boxes in each row, and three vertical columns of three boxes in each column, as in the conventional tick-tack-toe game. The electrical conductive elements carried by the printed circuit board 308 are formed so that if an X is traced by the stylus in any box, one electrical circuit (e.g., that to lead 311*x* in box C) is closed, and if a O is traced in any one box, a second electrical circuit (e.g., that to lead 311*o*) is closed. For this purpose, each box as shown particularly in box-C) contains a first conductive deposit 310*x* in the form of a circle in the center of its respective box and connected to its respective lead 311*x*, and a second conductive deposit 310*o* radially spaced from deposit 310*x* and connected to its lead 311*o*. The connections of the conductive deposits to their respective leads must not be exposed on the upper face of the printed circuit board; they may be formed either on the lower face of the board, or they may be covered by a protective layer.

Overlying printed circuit board 308 is a flexible sheet assembly including a flexible plastic sheet 316 coated on its underface with a conductive metal layer 318, the conductive layer being in turn coated with a wax layer 314. Overlying the upper face of flexible sheet 316 is an opaque flexible sheet 320 also of plastic, sheet 320 being separate from and not bonded to sheet 316.

The upper opaque sheet 320 carries a number of markings. Thus, it is marked with two vertical lines 321 and two horizontal lines 323, thereby dividing the sheet into the rectangular matrix of nine boxes, conforming to and aligned with the nine boxes described above with respect to the printed circuit board 308. In addition, the overlying opaque sheet 320 includes markings in each box corresponding to the O and X marks conventionally used in playing the tick-tack-toe game, these markings being shown as 325*x* for the X mark, and 325*o* for the O mark.

It will be seen that the 325*x* mark overlies conductive deposit 310*x* on the printed circuit board 308 so that if the player traces an X mark he will cause the wax layer 314 to part and to bring conductive layer 318 into contact with conductive deposit 310*x* of the printed circuit board in the respective box; and if he traces a O mark along marking 325*o*, he will cause the wax layer 314 to part and to bring the conductive layer 318 into contact with conductive deposit 310*o* of the printed circuit board in the respective box. Conductive layer 318 is connectd to a battery 327, so that when an X mark is traced, conductive layer 318 and conductive deposit 310*x* act as an electrical switch which is closed to complete the circuit from the battery to lead 311*x* of the respective box; and when a O mark is traced, conductive layer 318 and conductive deposit 310*o* act as a second electrical switch which is closed to complete the circuit from the battery to lead 311*o* of the respective box.

Figure 2:
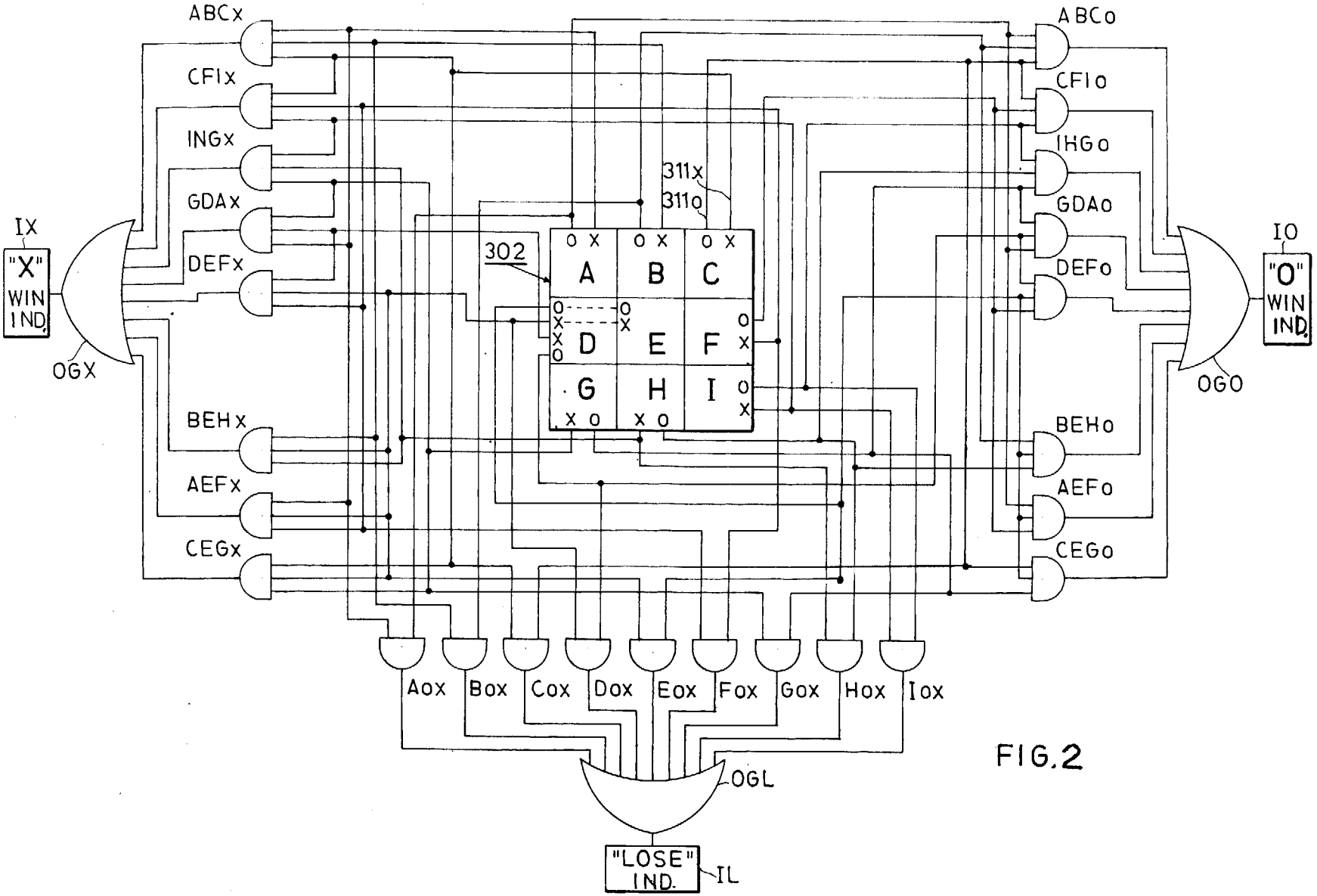
FIG. 2 illustrates the electrical circuit used with the device of FIG. 1.

FIG. 2 illustrates an electrical circuit that may be used to provide a first indication whenever the first-mentioned electrical switches (conductive layer 318 and conductive deposit 310*x*) of the three boxes in any horizontal row, vertical column, or diagonal are all closed; and a second indication whenever the second-mentioned electrical switches (conductive layer 318 and conductive deposit 310*o*) of the three boxes in any horizontal row, vertical column, or diagonal are all closed. The circuit of FIG. 2 is also effective to provide a third indication whenever the first and second electrical switches in any one box are both closed. Thus, the first indication indicates that the X player wins; the second indication indicates that the O player wins; and the third indication indicates that the player applied his mark to a box that had previously received a mark from the other player, and therefore loses.

The latter indication, present in the illustrated electronic version of the game, adds an additional element to the game in that the players must not only exercise their skill in trying to win the game, as in the existing conventional versions, but also must exercise their memory to remember all the previous markings (these being masked by the opaque upper sheet 320 so as not to apply the mark to a box previously marked by the other player; this element of memory is not present in the existing conventional versions.

The circuit of FIG. 2 illustrates the basic stylus-actuated switching device 302 (described above with respect to FIG. 1) and the two electrical leads (e.g. 311*x*, 311*o*) leading from each of the nine boxes A–I of the device, the electrical circuit to lead 311*x* being closed when an X-mark is scribed in the respective box, and the circuit to lead 311*o* being closed when an O-mark is scribed in the respective box.

The first electrical circuit mentioned above includes eight AND-gates ABC*x*–CEG*x* connected to the X-leads (e.g.311*x*) of the nine boxes A–I. Each of these AND-gates includes three inputs, one from each of the X-leads of the three boxes in the respective horizontal row, vertical column or diagonal, there being eight such gates for the eight different possible combinations. Thus, AND-gate ABC*x* is connected to the X-leads of the boxes of A,B and C; AND-gate CFI*x* is connected to the X-leads of boxes C, F, and I; AND-gate IHG*x* is connected to the X-leads of boxes C,F and I; AND-gate IHG*x* is connected to the X-leads of boxes I, H, and G; — and the eighth gate illustrated, CEG*x*, is connected to the X-leads of boxes C,E and G.

Thus, whenever an electrical circuit is completed to the three X-leads in any horizontal row, vertical column or diagonal, an output will be produced from the respective gate ABC*x*–CEG*x*.

The outputs of all eight gates are connected to the input of an OR-gate OGX, and the output of that gate controls an electrically-actuatable indicator IX located outside the rectangular matrix of the switching device 302. Accordingly, if the X-marker is successful in closing the electrical switches in the three boxes in any horizontal row, vertical column or diagonal, indicator IX will be energized to indicate that the X-marker wins.

A similar arrangement is provided with respect to the O-leads (e.g., 311*o* of box C) for all nine boxes in the stylus-actuated switching device 302. Thus, there are eight AND-gates ABC*o* – CEG*o*, each having three inputs connected to the O-leads in the three boxes of each horizontal row, vertical column, or diagonal. The outputs of these eight AND-gates are connected to the input of a second OR-gate OGO, the output of which is connected to a second electrically-actuatable indicator IO also located outside the rectangular matrix of the switching device 302, which indicator is energized whenever an electrical circuit is completed to the O-leads of the three boxes in any horizontal row, vertical column, or diagonal, thereby indicating that the O-marker wins.

The third circuit mentioned above, which indicates that a marker is applied to a box that had already received a mark from the other player, includes nine ANd-gates Aox–Iox, one for each of the nine boxes A–I of the stylus-actuated switching device 302. Each of these nine AND-gates includes two inputs connected to both the O-lead and the X-lead of the respective box, so that it will produce an output whenever both leads are energized by the engagement of their respective contacts 310*x*, 310*o* with the conductive layer 318. The outputs of the above nine AND-gates are connected via an OR-gate OGL to an indicator IL which is energized whenever both conductive deposits in any one square are brought into contact with the conductive layer 318, thereby indicating that the marker who caused the energization of indicator IL loses.

As indicated above, the illustrated electronic version of the game provides not only the usual element of skill present in the existing mechanical versions of the game, but also the element of memory since it requires each player to remember all the previous markings (which are masked by the opaque sheet 320 in order not to apply his mark to a box previously marked by the other player. If no player wins or loses after nine turns, the game ends in a draw. If desired, a counter could be provided to count the number of turns, so that after nine markings, an additional indicator is energized to indicate the "draw". If a player applies his mark to a box in which he had previously applied his mark, this is not recognized by the game, but in effect that player has merely wasted his turn thereby decreasing his chances of winning.

After the game has been completed, it is only necessary to separate the flexible sheet 316 including its conductive layer 318 from the printed circuit board 308, which separates all the contacts from the conductive layer, thereby clearing the device and enabling the game to be played again.

While the electrical circuit of FIG. 19 appears complicated, actually it can be implemented in a simple and inexpensive manner by using integrated circuit chips. The indicators OGO, OGX and OGL may be separate and distinct light-emitters, or then be embodied in a single matrix of light-emitting elements (e.g., light-emitting diodes), certain ones being energized to indicate the X, others being energized to indicate the O, and still others or all being energized to indicate a "double-marking".

It will be appreciated that the stylus-actuated switching device 302 could be included within a holder such as shown in FIG. 5 for example of my application 490,682. It will also be appreciated that the AND-gates and OR-gates illustrated include their inverted counterparts, namely NAND-gates and NOR-gates, respectively.

Many other variations, modifications, and applications of the illustrated embodiments of the invention will be apparent.

What is claimed is:

1. An electrical Tick-Tack-Toe game comprising an electrical switching device having a face divided into a rectangular matrix of nine boxes arranged in three horizontal rows of three boxes in each row, and three vertical columns of three boxes in each column; a first and a second electrical switch in each box; a first electrically-actuatable indicator located outside said rectangular matrix; a second electrically-actuatable indicator located outside said rectangular matrix; and electrical circuit means including a first electrical circuit effective to actuate said first indicator to provide a first indication whenever said first electrical switches of the three boxes in any horizontal row, vertical column, or diagonal are all closed, and a second electrical circuit effective to actuate said second indicator to provide a second indication whenever said second electrical switches of the three boxes in any horizontal row, vertical column, or diagonal are all closed.

2. An electrical Tick-Tack-Toe game according to claim 1, wherein said electrical switching device is a stylus-actuated switching device having a supporting member carrying a plurality of conductive elements, an overlying flexible sheet carrying a conductive layer, and a separating layer of wax separating the conductive layer of the latter sheet from the conductive elements of the supporting member, said flexible sheet being divided into a rectangular matrix of nine boxes arranged in three horizontal rows of three boxes in each row, and three vertical columns of three boxes in each column, the conductive elements of the supporting member and the conductive layer of the flexible sheet being arranged so as to constitute said first electrical switch which is closed when a first symbol is traced by the stylus in each box, and to constitute said second electrical switch which is closed when a second symbol is traced by the stylus in each box.

3. The game as defined in claim 2, wherein said conductive elements of the supporting member include a first conductive deposit in the center of each box so as to be contacted by the conductive layer of the flexible sheet when an X is traced by the stylus, and a second conductive deposit in each box but spaced radially from the first conductive deposit so as to be contacted by the conductive layer of the flexible sheet when a O is traced by the stylus.

4. An electrical game according to claim 2, further including a flexible opaque sheet overlying said flexible sheet to mask same and any tracings applied thereto by the stylus, said flexible opaque sheet including markings dividing same into said rectangular matrix of nine boxes.

5. An electrical game according to claim 1, wherein said first electrical circuit includes a first group of eight AND-gates each including three inputs one connected to each of the first electrical switches of the three boxes of the eight different horizontal rows, vertical columns, and diagonals in the matrix; and wherein said second electrical circuit includes a second group of eight AND-gates each including three inputs one connected to each of the second electrical switches in the three boxes of the eight different horizontal rows, vertical columns, and diagonals.

6. An electrical game according to claim 5, wherein said first electrical circuit further includes a first OR-gate having eight inputs connected to the outputs of the first group of eight AND-gates, a first electrical indicator controlled by the output of said first OR-gate, a second OR-gate having eight inputs connected to the outputs of the second group of eight AND-gates, and a second electrical indicator controlled by the output of said second OR-gate.

7. An electrical game according to claim 1, wherein said electrical circuit means further includes a third electrical circuit effective to provide a third indication whenever said first and second electrical switches are both closed in any one box.

8. An electrical game according to claim 7, wherein said third electrical circuit includes nine AND-gates each having two inputs connected to the first and second electrical switch of each box, an OR-gate having nine inputs connected to the output of the latter nine AND-gates, and an electrical indicator connected to the output of the latter OR-gate.

9. An electrical Tick-Tack-Toe game comprising a printed circuit board containing a plurality of electrically conductive elements, a flexible sheet member overlying the printed circuit board and formed with a conductive layer facing the electrically conductive elements thereof, and a wax layer interposed between the conductive elements of the printed circuit board and the conductive layer of the flexible sheet, said flexible sheet being divided into a rectangular matrix of nine boxes arranged in three horizontal rows of three boxes in each row, and three vertical columns of three boxes in each column, the conductive elements of the printed circuit board and the conductive layer of the flexible sheet being arranged so that if a first symbol is traced by the stylus in each box, the wax layer parts to bring the conductive layer of the flexible sheet into contact with a first conductive element of the printed circuit board, and if a second symbol is traced by the stylus in each box, the wax thereunder parts so as to bring the conductive layer of the flexible sheet into contact with a second electrical conductive element on the printed circuit board; said game further including circuit means comprising a first electrical circuit effective to provide a first indication whenever said conductive layer on the flexible sheet is brought into contact with said first conductive element of the three boxes in any horizontal row, vertical column, or diagonal; and a second electrical circuit effective to provide an indication whenever said conductive layer on the flexible sheet is brought into contact with said second electrical conductive element of the three boxes in any horizontal row, vertical column, or diagonal.

10. The game according to claim 9, wherein said conductive elements of the printed circuit board include a first conductive deposit in center of each box so as to be contacted by the conductive layer of the flexible sheet when an X is traced by the stylus, and a second conductive deposit in each box but spaced radially from the first conductive deposit so as to be contacted by the conductive layer of the flexible sheet when a O is traced by the stylus.

* * * * *